United States Patent [19]

Lindley

[11] Patent Number: 4,481,938

[45] Date of Patent: Nov. 13, 1984

[54] RESUSCITATOR, RESPIRATOR AND/OR INCUBATOR

[76] Inventor: John E. Lindley, 1410 20th Ave., Meridian, Miss. 39301

[21] Appl. No.: 312,322

[22] Filed: Oct. 16, 1981

[51] Int. Cl.[3] ..... A61H 31/02

[52] U.S. Cl. ..... 128/30; 128/1 B; 128/205.26

[58] Field of Search ..... 128/1 B, 205.26, 30, 128/205.28, 203.28, 205.7, 204.24, 204.26, 205.12, 205.16, 205.17, 205.29, 28

[56] References Cited

U.S. PATENT DOCUMENTS

| | | | |
|---|---|---|---|
| 2,263,844 | 11/1941 | Hammond | 128/30 |
| 2,292,120 | 8/1942 | Hanby | 128/1 B |
| 2,776,657 | 1/1957 | Batson et al. | 128/1 B |
| 2,810,384 | 10/1957 | Bloxsom | 128/28 |
| 2,822,803 | 2/1958 | Huxley et al. | 128/30 |
| 2,863,447 | 12/1958 | Lindley et al. | 128/30 |
| 3,070,086 | 12/1962 | Smith et al. | 128/1 B |
| 3,313,295 | 4/1967 | Robinson | 128/30 |
| 3,814,091 | 6/1974 | Henkin | 128/205.28 |
| 3,814,692 | 6/1974 | Simionescu et al. | 128/203.28 |

*Primary Examiner*—Henry J. Recla
*Assistant Examiner*—Karin M. Reichle
*Attorney, Agent, or Firm*—Cushman, Darby & Cushman

[57] ABSTRACT

A resuscitator or respirator, especially designed for newborn infants, has a pressure chamber divided by a partition into separate gas-tight head and body compartments. The partition has a neck-receiving opening provided with neck-engaging sealing means. Means are provided for automatically admitting an oxygen-containing breathable gas alternately to one of the compartments under a predetermined positive pressure and then to the other of the compartments under another predetermined positive pressure while alternately creating a predetermined negative pressure in the other compartment and then another predetermined negative pressure in the one compartment. The time interval of each of the alternate admissions and negative pressure creations is predetermined to thereby perform respiratory cycles for a patient in the chamber with the duration of the inspiratory portion and of the expiratory portion of each cycle being predetermined.

20 Claims, 5 Drawing Figures

RESUSCITATOR, RESPIRATOR AND/OR INCUBATOR

BACKGROUND OF THE INVENTION

This invention relates to improvements in newborn infant resuscitators, respirators and/or incubators of the type having separate head and body compartments, such as is disclosed in the patent to my father and me, U.S. Pat. No. 2,863,447, Dec. 9, 1958.

While the resuscitator disclosed in that patent satisfactorily performs its intended functions, improvements are possible and desirable. For example, the controlled application of predetermined positive and negative pressures alternately to both the head and to the body compartments could not be achieved. The lack of negative pressure application to both compartments is not wholly satisfactory. Further, positive control of negative pressures could not be had.

The invention also relates to improvements in the neck-sealing collar disclosed in the patent to my father and me, U.S. Pat. No. 2,841,140, July 1, 1958. Again, while that collar satisfactorily performs it intended function, improvements are possible and desirable.

BRIEF SUMMARY OF THE INVENTION

Accordingly, it is an object of this invention to provide an improved infant resuscitator, respirator and/or incubator having separate pressure-tight head and body compartments.

It is another object of this invention to provide such a resuscitator and/or respirator that is operable with a mixture of air and oxygen in predetermined proportions.

It is another object of this invention to provide such a resuscitator and/or respirator wherein there can be had alternate application of predetermined positive and negative pressures in the head and body compartments for predetermined periods of time.

It is another object of this invention to provide such a resuscitator and/or respirator which will produce active inspiration with controlled concentric pulmonary expansion by a sustained positive intratracheal pressure and a simultaneous gradual release of positive extrathoracic pressure followed by a negative extrathoracic pressure while the positive intratrachaeal pressure continues to the very end of inspiration.

It is another object of this invention to provide such a resuscitator and/or respirator which will produce active expiration by a gradually increasing positive pressure on the thorax and diaphragm and a simultaneous negative pressure is exerted in the intratracheal passage.

It is another object of this invention to provide an improved neck collar for providing a seal between the head and body compartments of the resuscitator.

The above objects are attained by the provision of a resuscitator and/or respirator having pressure-tight head and body compartments cyclically alternately supplied with a mixture of air and oxygen in predetermined proportions and under predetermined positive pressure in one compartment with a predetermined negative pressure in the other for predetermined periods of time to positively control the time periods of inspiration and expiration of a patient.

Other objects and advantages of the invention will become apparent from the following detailed description and accompanying drawings, in which:

DETAILED DESCRIPTION OF THE INVENTION PRESSURE CHAMBER

This invention relates to an improved resuscitator and/or respirator, which also can be used as an incubator, especially adapted for the treatment of apnea neonatorium as well as respiratory distress syndrome and other respiratory problems of infants. It will be realized, however, that a resuscitator embodying the principles of the invention can be used for adults as well as for infants.

The resuscitator preferably is mounted on a portable wheeled stand 10 having interior compartments closed by doors 12 for housing some of the various mechanical, pneumatic and electrical components.

Figure 1:
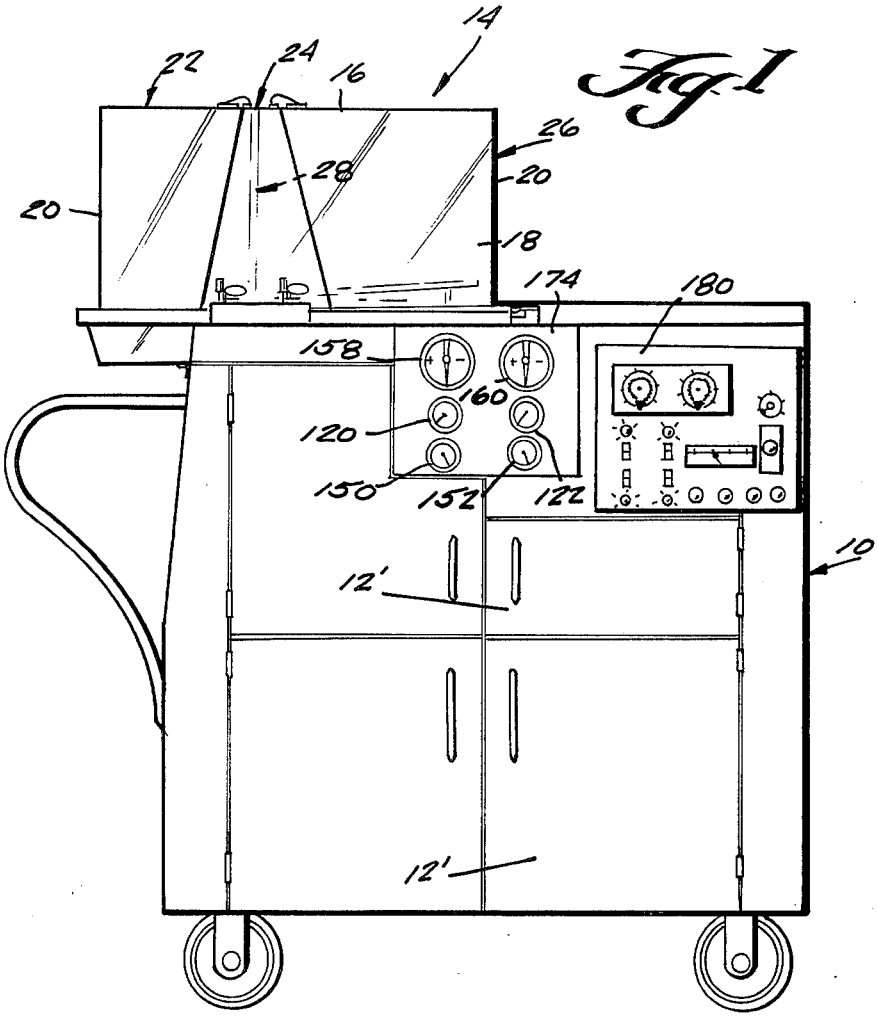
FIG. 1 is a front view of an infant resuscitator, respirator and/or incubator embodying this invention.
Figure 3:
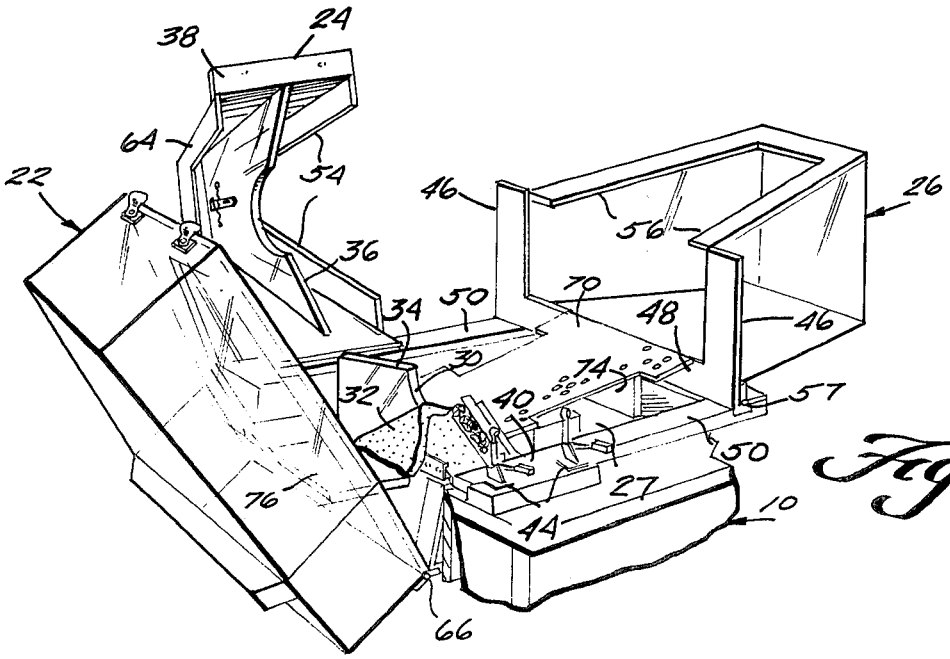
FIG. 3 is a view corresponding to FIG. 2 showing the open position of the chamber shown in FIG. 2.
Figure 2:
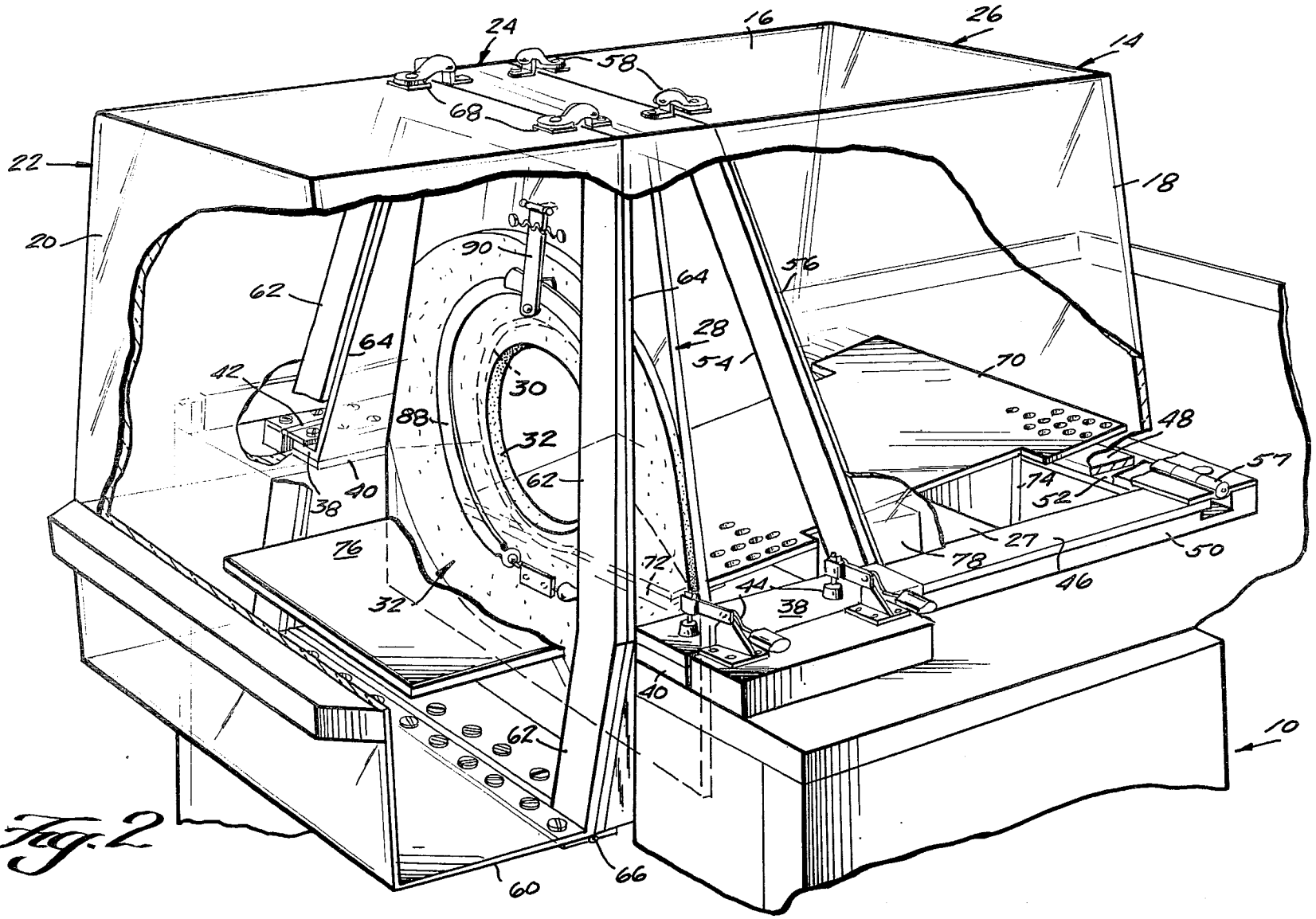
FIG. 2 is an enlarged fragmentary view of the pressure chamber of the resuscitator shown in FIG. 2, with parts broken away to better show details.

Supported on top of the stand 10, adjacent one end thereof, is a housing 14 having top, side and end walls 16, 18 and 20, respectively, forming, together with the stand 10, a pressure-tight chamber for enclosing the patient. The side walls 18 may diverge downward from the top wall 16. The housing 14 is formed in three sections, a head section 22, a middle section 24, and a body section 26, all formed of suitable transparent plastic to enable viewing the patient at all times. The bottom wall of the chamber is defined, for the most part, by the top of the stand 10 which may have a recess or depression 27 therein beneath the housing 14. All of the sections 22, 24, 26 are movable as later described, so that the chamber can be opened completely, as shown in FIG. 3, to enable a patient to be placed therein and removed therefrom readily, gently and quickly. The chamber is divided into a body compartment and a head compartment by a transverse upright partition 28 in the middle section 24. The partition 28 preferably is of transparent plastic and has a central generally circular aperture 30 through which the neck of a patient extends. The patient's neck is sealed to the edges of the aperture 30 by an adjustable sealing collar 32 described in detail hereinafter. The partition 28 is divided, along lines inclined downwardly and outwardly toward the side walls 18 from diametric opposite sides of the aperture 30, into a lower portion 34 rigidly secured to the stand 10 and an upper portion 36 that is secured to the middle section 24 and is movable therewith to enable the patient to be laid gently in the chamber without undue handling or trauma. The meeting edges of the lower and upper portions 34 and 36 of the partition 28 may have appropriate seals (not shown) interposed therebetween or the necessary seal may be effected by the sealing collar 32 as later described.

The side and upper edges of upper portion 36 of the partition 28 are secured to the housing middle section 24 which has a narrow top wall portion and side wall portions that have downwardly diverging side edges and outturned flanges 38 at their lower edges engaging suitable sealing strips 40 on the top of the stand 10. One of the flanges 38 is hinged, as at 42, to the stand top so that the middle section 24 can be swung upward and rearward to open the chamber as shown in FIG. 3. The other flange 38 is releasably engageable by hold-down clamps 44 to releasably secure the middle section 24 in closed position.

Outturned flanges 46, 48 along the lower edges of the side and end walls, respectively, of the body section 26 engage suitable sealing strips 50, 52, respectively, on the top of the stand 10, while inturned flanges 54, 56 along the meeting edges of the top and side walls of the middle and body sections 24 and 26, respectively, have suitable seals (not shown) interposed therebetween. The body section 26 of the housing 14 is hinged to the top of the stand 10 along the outturned flange 48 on the end wall 20, as at 57, so that it can be swung endwise upward away from the middle section 24 to open the chamber as shown in FIG. 3. Appropriate latches 58 on the top walls of the middle and body sections 24, 26 releasably retain the body section 26 in closed sealing engagement with the middle section 24 and with the top of the stand 10.

The side and end walls of the head section 22 are located beyond or outward of the corresponding end of the stand 10 and depend below the top thereof to a bottom wall 60. Appropriate seals (not shown) are interposed between inturned flanges 62 and 64 along the meeting edges of the top and side walls of the head and middle sections 22 and 24, respectively, and between the edges of the bottom 60 and the side walls 18, respectively, of the head section and the opposed end of the stand 10. The inner edge of the bottom wall 60 is hinged to the adjacent end of the stand 10, as at 66, so that the head section 22 can be swung endwise outward and downward to open the chamber as shown in FIG. 3. Suitable latches 68 on the top walls of the head and middle sections 22 and 24 releasably retain the head section in closed sealing engagement with the middle section and the corresponding end of the stand 10.

Preferably a platform 70, for supporting a patient's body, is disposed within the lower portion of the body compartment and is hinged at one end, as at 72, to the fixed lower portion 34 of the partition 28, or to the top of the stand 10, for tilting movement about a horizontal axis. A support block 74 for the platform 70 is interposed between the other end portion of the platform and the top of the stand 10 and is movable toward and away from the hinged end to adjust the angle of inclination of the platform as desired. A headrest 76 likewise is disposed within the head compartment and is adjustably supported by means, not shown, to raise or lower the patient's head as desired. Desirably, a thermostatically controlled electric heater 78 is disposed in the body compartment at an appropriate location, e.g., beneath the platform 70, to maintain a predetermined temperature in the body compartment.

Figure 5:
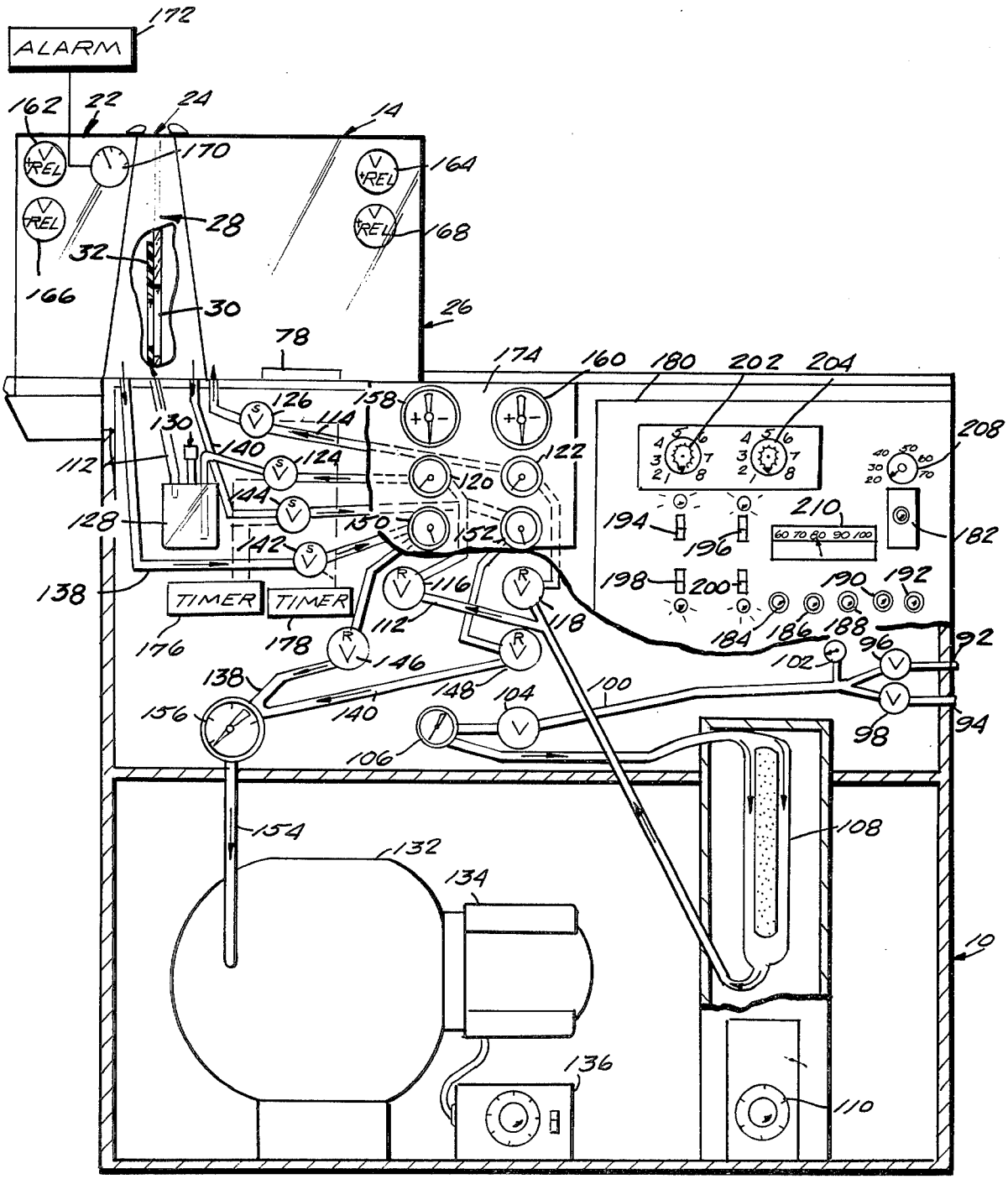
FIG. 5 is a schematic diagrammatic view of the resuscitator shown in FIG. 2 illustrating the several fluid connections and electric controls.

The sealing collar 32 referred to above is a flat radially-split annulus of sponge rubber, or equivalent resilient sealing material, disposed in the head compartment generally coaxially about the neck-receiving aperture 30 in the partition 28 separating the head and body compartments of the chamber. The outer periphery of the collar 32 may be non-circular and located well outward beyond the edge of the aperture 30. The inner edge of the collar is circular and of a diameter less than that of the aperture 30. The lower portion of the collar 32 is detachably secured to the fixed lower portion 34 of the partition 28 by an elongated washer-like plate 80 and bolts and nuts 82 which clamp the lower portion of the collar to the lower portion of the partition but permit removal for replacement or cleaning. The marginal edge portions of the collar 32, at the split therein, are circumferentially extended to overlap considerably, as at 84, to enable adjustment of the size or inner diameter of the collar to fit snugly about necks of different size. The opposed surfaces of the overlapping portions 84 of the collar 32 preferably are provided with Velcron type means for adhering the portions together to retain the collar in its adjusted size. Mounted to the plate 80 by ball and socket joints 86 is a pair of arcuate generally-flat arms 88, preferably of stainless steel, which surround the aperture 30, with their upper ends crossed, and press the collar 32 against the partition 28 to seal it thereto. A releasable spring-pressed clamp type latch 90 secured to the upper portion 36 of the partition 28 presses against the crossed ends of the arms 88 to retain them in operative position. The latch 90 is in the form of an arm pivoted at its upper end on a horizontal pivot pin 91 secured to the partition 28 by any appropriate fastening means, e.g. bolts 91' and nuts (not shown). A coil tension spring 93 is stretched across the upper portion of the latch 90 with the ends of the spring secured to the partition 28 by any appropriate means, e.g. bolts 93' and nuts (not shown) to urge the latch against the crossed ends of the arms 88. The radial extent of the collar 32 may be sufficient to cover the parting lines between the upper and lower partition portions 34 and 36 to provide a seal therebetween, as shown in FIG. 5.

PRESSURE CONTROL SYSTEM

The head and body compartments are alternately in reverse cycles supplied with a mixture of air and oxygen under predetermined positive pressure and connected to a predetermined subatmospheric or negative pressure. The duration of each portion of a cycle also is predetermined. For this purpose the stand 10 is provided with inlet connection 92 and 94 for air and oxygen, respectively, from any suitable sources (not shown), e.g. the usual wall outlets in a hospital or conventional compressed air and oxygen tanks. The inlet connections 92 and 94 are provided with manually-operable flow control valves 96 and 98, respectively, whereby the ratio of air to oxygen can be adjusted. The inlet connections 92 and 94 join downstream of the valves 96, 98 into a supply line 100 for the air/oxygen mixture. Preferably a gauge 102 for indicating the percentage oxygen of the mixture is connected to the supply line 100. Also connected into the supply line 100 is a manually operable flow control valve 104 and downstream thereof a flow gauge 106 to indicate flow of the air/oxygen mixture, e.g. in liters per minute. Downstream of the gauge 106 the oxygen/air mixture is passed through a suitable heater 108 controlled by a manually adjustable temperature regulator 110 to heat the mixture to a predetermined temperature. Downstream of the heater 108 the supply line has two branches, 112 connected to the head compartment and 114 connected to the body compartment. Connected into the branch line 112 and 114 are adjustable pressure regulating valves 116 and 118, respectively, along with downstream pressure gauges 120 and 122, respectively, and downstream normally-closed solenoid valves 124 and 126, respectively. Downstream of the solenoid valve 124 the head compartment branch supply line 112 preferably has conventional electrically-operable adjustable humidifying apparatus 128 connected thereto to prevent dehydration of the mucous membranes of the patient's respiratory tract. The humidifying apparatus 128 desirably has a connection 130 for the introduction of aerosol type medication into the humidified inspired mixture.

Sub-atmospheric pressures in the head and body compartments are attained by a vacuum tank or chamber 132 connected to a unitary turbine-type vacuum pump and explosion proof, electric motor 134 having an adjustable speed control 136. Adjustment of the motor speed controls the sub-atmospheric pressure in the vacuum chamber 132, normally below than that required in the head and body compartments. Separate vacuum lines 138 and 140 respectively, lead from the head compartment and the body compartment, first through normally closed solenoid valves 142 and 144, respectively, and then through adjustable negative pressure or vacuum regulators 146 and 148, respectively. Negative pressure gauges 150 and 152 are connected to the vacuum lines 138 and 140, respectively, between the valves 142, 144 and the regulators 146, 148. Beyond the regulators 146, 148 the lines 138, 140 are joined to a vacuum line 154 connected to the vacuum chamber 132. Preferably a negative pressure gauge 156 is connected to the line 154 or to the chamber 132.

Figure 4:
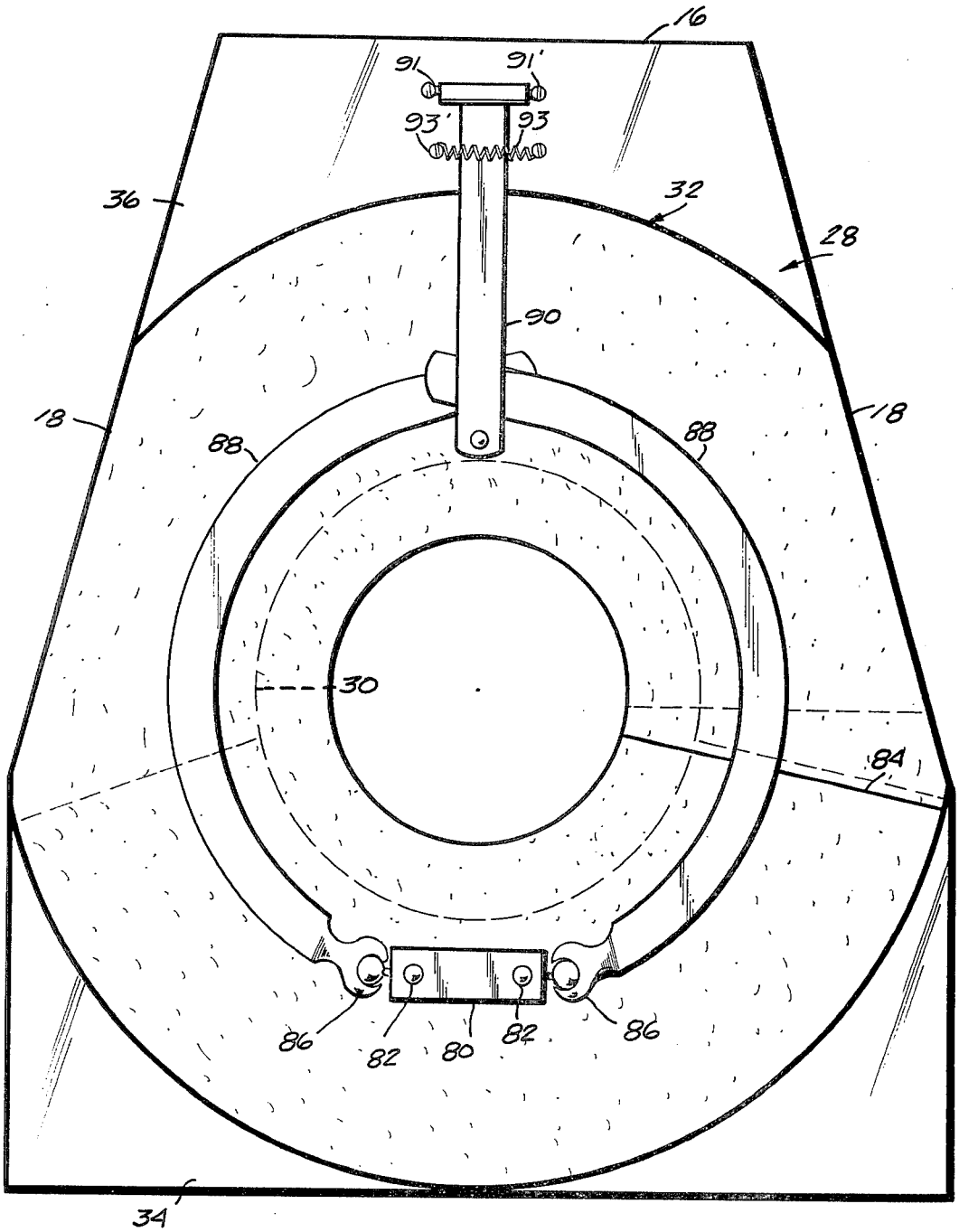
FIG. 4 is an enlarged fragmentary elevational view of the neck-sealing collar and associated parts shown in FIG. 2, the collar being shown in neck-sealing position.

Connected to the head and body compartments are positive/negative pressure gauges 158 and 160, respectively, to show the degree of positive or negative pressure therein at all times. Connected to the compartments are automatic adjustable positive pressure safety relief valves 162, 164 and automatic adjustable negative pressure safety relief valves 166, 168 to avoid dangerous over pressures or under pressures in the event of failure of any of the control equipment, e.g. the regulators 116, 118, 146, 148. Preferably the head compartment also has connected thereto a percentage oxygen concentration gauge 170 to show the percentage of oxygen inspired by the patient at all times. The gauge 170 preferably incorporates an adjustable alarm 172 to warn if the oxygen concentration changes from that preset by adjustment of the valves 96 and 98. Although the relief valves 162, 164, 166, 168 and gauge 170 are illustrated in FIG. 4 as being connected to the housing 14, the showing in that Figure is only diagrammatic and in actual practice these components would be connected to those portions of the stand top forming walls for the compartments.

Preferably the pressure gauges 120, 122, 150, 152, 158 and 160 are displayed on an instrument panel 174 at the front of the stand 10, while the gauges 102, 106 and 156 and adjustable valves 96, 98, 104 and regulators 116, 118, 146, 148 are mounted within the stand 10 for ready viewing and accessibility when the stand doors 12 are open.

The solenoid valves 124, 126, 142 and 144 are operated in timed relation by appropriate conventional electric circuitry (not shown) whereby valves 124 and 144 are opened to initiate the inspiration portion of the respiratory cycle of a patient by admitting the air-oxygen mixture to the head compartment under predetermined positive pressure, e.g. 10 cm of water, to produce sustained positive intratracheal pressure, while the body compartment is connected to predetermined negative pressure to gradually release the previous positive extrathoracic pressure therein. This is believed to accomplish a more equal filling and expansion of all pulmonary alveoli. The pressure continues to be reduced in the body compartment until the predetermined negative pressure, e.g. minus 10 cm of water, is applied on the thorax. The valves 124, 144 are under the control of an adjustable timer 176 to stay open for a predetermined period of time, and then close, whereupon the circuitry opens valves 126 and 142 to initiate the expiration portion of the respiratory cycle by admitting the air/oxygen mixture under predetermined pressure to the body compartment to produce a gradual rise in positive extrathoracic pressure until the predetermine positive pressure, e.g. 14 cm of water, is applied to the thorax and diaphragm. At the same time the head compartment is connected to a predetermined negative pressure to quickly reduce the previous positive pressure therein to the predetermined negative pressure, e.g. minus 5 cm of water, to quickly remove carbon dioxide and other expired gases and exert negative intratracheal pressure. The valves 126 and 142 are also under the control of an adjustable timer 178 to remain open for a predetermined period of time before closing. Preferably the inspiration portion is of longer duration than the expiration portion of the respiratory cycle to assure blood oxygen saturation. The circuitry then reopens valves 124 and 144 to begin another breathing cycle of inspiration and expiration for the patient.

The resuscitator also preferably includes a panel 180 on the front of the stand 10 for the various electrical controls. These include, in addition to an off-on switch 182 for the main power supply, off-on switches for independent control of the several component circuits. Thus, these are switches 184 for the vacuum pump motor 134, 186 for the body compartment heater 78, 188 for the air/oxygen mixture heater 108, 190 for the humidifier 128, 192 for the timers 176, 178 and 194, 196, 198 and 200, each having a signal light, 202, 204, 206, 208 for the respective solenoid valves 124, 126, 142 and 144. The panel also includes timer setting controls 202 and 204, a humidity control 208 for the humidifier 128, and a temperature control 210 for the body compartment heater 78.

OPERATION

To use the resuscitator main power switch 182 is turned on and the valves 96, 98 are opened and adjusted, while viewing the gauge 102, to provide an air/oxygen mixture with the desired percent of oxygen, and the valve adjusted 104, while viewing the flow gauge 106, to provide the desired flow rate for the mixture. The pump-motor switch 184 is turned on and the motor speed control adjusted 136, while viewing the vacuum gauge 156 to provide the desired negative pressure in the vacuum chamber 132. The regulators 116 and 118 are adjusted to provide the desired positive pressures for the air/oxygen mixture in the head and body compartments, and the regulators 146 and 148 adjusted to provide the desired negative pressures in the head and body compartments. The switches 186 and 188 are turned on and the controls 210 and 110 for the heaters 78 and 108, respectively, are adjusted for the desired temperature of the air/oxygen mixture and the desired temperature in the body compartment. The switch 190 for the humidifier 128 is turned on and the humidity control 208 is adjusted to provide the desired humidity for the air/oxygen mixture in the head compartment.

The timer controls 202, 204 are adjusted to provide the medically indicated times for the inspiration and expiration portions of the breathing or respiratory cycle. The timer controls 202, 204 also make it possible to provide positive end expiratory or inspiratory pressure by having residual positive pressures in the head compartment at the end of expiration or inspiration. Positive end expiration pressure is thought to be useful in the treatment of the respiratory distress syndrome of infants. Of course, the various controls may, and probably will, be further adjusted during treatment of a patient to best suit his or her medically indicated needs.

The pressure chamber is then opened by releasing the latches 58, 68 and swinging the head and body housing sections 22, 26 to their fully open positions. The clamp 90 is released, the arms 88 swung open, the overlapping collar edges 84 are pulled apart, and the collar 32 opened to receive the neck of the patient. The clamps 44 are then released and the middle housing section 24 swung open.

The infant patient can then be laid gently in the open chamber, without excess handling or trauma, with the body on the platform 70, the head on the headrest 76, and the neck extending across the open collar 32 and the concavity of the lower part of the aperture 30 in the upper edge of the lower portion 34 of the partition 28. The platform 70 is adjusted, by moving the block 74, to the desired inclination, and likewise the headrest 76 adjusted to the desired elevation. Preferably the head is lower than the body so that the secretions can drain from the chest cavity to the pharynx where they can be aspired with a rubber bulb aspirator. The middle section 24 of the housing 14 is then swung closed and locked in place by the hold-down clamps 44. The collar 32 is then closed with the extent of overlap of the overlapping edges adjusted so that the collar seals snugly about the patient's neck. The collar-pressing arms 88 are then swung to their closed ends-crossed position and the latch 90 engaged to press the collar 32 tightly against the partition 28 and over the parting line between its lower and upper portions, 34, 36 to provide an air-tight seal between the compartments.

A plastic oral airway desirably is placed in the patient's mouth to keep the tongue back and the air passages open. The solenoid switches 194, 196, 198 and 200 are then closed to activate the respiratory cycle. The head and body sections 22, 26 of the housing 14 are then swung closed and secured to the middle section 24 by the latches 58, 68. Whereupon effective resuscitation or respiration is accomplished automatically.

The ready accessibility of the head and body of the patient permits the installation of monitoring equipment, such as an electrocardiogram, etc. Further, either the head or body compartment can be opened while leaving the other closed with no interruption to constant ventilation of a patient's lungs. When only the head compartment is closed, there is alternating positive and negative pressure down into the lungs with expiration assisted by passive collapse and pressure of the thoracic cage [ribs and chest musculature]. When only the body compartment is closed, there is alternating positive and negative pressure on the chest which produces positive movements of the thoracic cage for both inspiration and expiration. Accordingly, examination or treatment of either the body or the head of the patient can be accomplished without interrupting ventilation. Of course, ventilation is more efficient when both compartments are closed.

It thus will be seen that the objects and advantages of this invention have been fully and effectively achieved. It will be realized, however, that the foregoing specific embodiment has been dsiclosed only for the purpose of illustrating the principles of this invention and is susceptible of modification without departing from such principles. Accordingly, the invention includes all embodiments encompassed within the spirit and scope of the following claims.

I claim:

1. A resuscitator comprising:

means defining a pressure chamber divided by a partition into separate gas-tight head and body compartments with said partition having a neck-receiving opening therein provided with neck-engaging sealing means; and means for automatically admitting an oxygen-containing breathable gas from a source thereof independent of the gas in said compartments alternately to one of said compartments under a predetermined positive pressure while simultaneously creating a predetermined negative pressure in the other of said compartments to withdraw and discharge to atmosphere the gas therein with the time interval of each of said alternate admissions and negative pressure creations being predetermined to thereby perform respiratory cycles for a patient in the chamber with the duration of the inspiratory portion and of the expiratory portion of each cycle being predetermined.

2. The structure defined in claim 1 in which the gas is a mixture of air and oxygen in predetermined proportions.

3. The structure defined in claim 2 in which the automatic means includes:

a gas supply line connected to each of the compartments;

branch lines connected to said supply line and adapted to be connected respectively to separate sources of air and oxygen under pressure for conducting the latter to said supply line;

adjustable valves in said branch lines for adjusting the proportions of the air/oxygen mixture in said supply line; and a percentage oxygen gauge in said supply line.

4. The structure defined in claim 1 including means for heating the gas to a predetermined temperature before its admission to the compartments.

5. The structure defined in claim 1 including means for humidifying the gas to a predetermined relative humidity before its admission to the head compartment.

6. The structure defined in claim 1 including means for mixing aerosol type medication with the gas before its admission to the head compartment.

7. The structure defined in claim 1 in which the automatic means includes:

a supply line from the source of the gas;

positive-pressure lines connecting said supply line to each of the compartments; and an adjustable pressure regulator in each of said positive-pressure lines.

8. The structure defined in claim 7 in which the automatic means further includes:

means defining a negative-pressure chamber;

means for evacuating said chamber to establish a predetermined negative pressure therein;

negative-pressure lines connecting each of the compartments to said negative-pressure chamber;

an adjustable negative-pressure regulator in each of said negative-pressure lines;

shut-off valve means in each of the positive-pressure lines and in each of said negative-pressure lines between the regulator therein and the respective compartment; and timing means for controlling the operation of said valve means.

9. The structure defined in claim 1 or 7 in which the automatic means includes:

means defining a negative-pressure chamber;

means for evacuating said chamber to establish a predetermined negative pressure therein;

negative-pressure lines connecting each of the compartments to said negative-pressure chamber;

and an adjustable negative-pressure regulator in each of said negative-pressure lines.

10. The structure defined in claim 1 in which the automatic means includes:

a supply line for the gas adapted to be connected to the source thereof and connected to each of the compartments;

a flow-rate regulating valve in said line; and a flow-rate gauge in said line.

11. The structure defined in claim 1 including means for heating the body compartment to a predetermined temperature.

12. The structure defined in claim 1 including an automatic positive-pressure safety relief valve connected to each of the compartments for relieving the pressure therein when it exceeds a predetermined positive pressure.

13. The structure defined in claim 1 including an automatic negative-pressure safety relief valve connected to each of the compartments for relieving the negative pressure therein when it is below a predetermined negative pressure.

14. In a resuscitator the combination comprising:

a base and a transparent housing having top, side and end walls, together defining a pressure chamber;

said housing comprising:

a middle section in sealing engagement with said base and hinged at one side to said base for lateral swinging movement, a body section in sealing engagement with said base and said middle section and hinged to said base for endwise swinging movement away from said middle section, and a head section in sealing engagement with said base and said middle section and hinged to said base for endwise swinging movement away from said middle section, swinging movement of said sections serving to open said chamber completely for reception of a patient or close said chamber into pressure tight condition;

latch means engaged with said head and body sections and said middle section, and with said middle section and said base, for releasably retaining said sections in closed position;

partition means in said middle section dividing said chamber into head and body compartments and having a neck-receiving aperture, said partition means being divided into upper and lower portions along parting lines extending laterally from substantially opposite sides of said aperture; said upper portion being fixed to said middle section and said lower portion being fixed to said base;

a substantially flat neck-engaging collar of portions and split generally radially with end edge portions of said collar adjacent said split circumferentially overlapping for adjustment of said collar to snugly fit the neck of a patient with the outer diameter of said collar being greater than the diameter of the neck-receiving aperture;

means securing the lower portion of the collar to the lower portion of said partition means with said collar substantially coaxial with the neck-receiving aperture;

a pair of generally arcuate arms having opposite end portions, said arms extending, respectively, along and on opposite sides of the neck-receiving aperture for pressing said collar against the partition means;

means including ball and socket joints securing one end portion of each arm to the partition means adjacent the lower portion of said collar for universal movement whereby the arms may be spaced apart for reception of the neck of a patient and moved to positions for pressing said collar against the partition means adjacent said neck-receiving aperture;

and means for detachably retaining the opposite end portion of each arm to the partition means adjacent the upper portion of said collar.

15. The structure defined in claim 14 including:

a body supporting platform in the body compartment; and means supporting said platform for adjustment of the endwise inclination thereof.

16. In a resuscitator having a patient chamber divided into head and body compartments by a wall with a neck aperture formed therein; the combination comprising:

a substantially flat neck-engaging collar of resilient sealing material having upper and lower portions and split generally radially with end edge portions of said collar adjacent said split circumferentially overlapping for adjustment of said collar to snugly fit the neck of a patient with the outer diameter of said collar being greater than the diameter of the neck aperture;

means securing said lower portion of said collar to the wall with said collar substantially coaxial with the neck aperture;

a pair of generally arcuate arms having opposite end portions, said arms extending, respectively, along and on opposite sides of the neck aperture for pressing said collar against the wall;

means including ball and socket joints securing one end portion of each arm to the wall adjacent the lower portion of said collar for universal movement whereby the arms may be spaced apart for reception of the neck of a patient and moved to positions for pressing said collar against the wall adjacent said neck aperture;

and means for detachably retaining the opposite end portion of each arm to the wall adjacent the upper portion of said collar.

17. The structure defined in claim 16 wherein the the opposite end portions of the arms adjacent the upper portion of said collar are crossed in their collar-pressing portions and the retaining means comprises latch means engageable with the outer of the opposite end portions when crossed.

18. The structure defined in claim 16 wherein the securing means comprises a plate detachably secured to the wall and clamping therebetween the collar lower portion, and the ball and socket joints are connected to the the one end portions of the arms and to said plate.

19. The structure defined in claim 16 wherein the arms are substantially flat throughout substantially their entire length.

20. The structure defined in claim 16 wherein the wall is split therethrough on opposite sides of the aperture into upper and lower portions said upper and lower wall portions connected to said patient chamber such that said upper portion is movable to open the aperture to receive a patient's neck, and wherein the radial extent of the collar is such that it substantially covers the end edge portions of said wall portions adjacent said split, when said collar is pressed against the wall, in order to form a seal.

* * * * *